US010271596B2

(12) United States Patent
Cookus

(10) Patent No.: US 10,271,596 B2
(45) Date of Patent: Apr. 30, 2019

(54) COLD WEATHER GLOVES AND MITTENS

(71) Applicant: GLUBBERS LLC, Pittson, PA (US)

(72) Inventor: Kellie Cookus, Pittston, PA (US)

( * ) Notice: Subject to any disclaimer, the term of this patent is extended or adjusted under 35 U.S.C. 154(b) by 546 days.

(21) Appl. No.: 14/856,015

(22) Filed: Sep. 16, 2015

(65) Prior Publication Data

US 2016/0128400 A1 May 12, 2016

Related U.S. Application Data

(60) Provisional application No. 62/078,232, filed on Nov. 11, 2014.

(51) Int. Cl.
*A41D 19/00* (2006.01)
*A41D 19/01* (2006.01)

(52) U.S. Cl.
CPC ..... *A41D 19/0006* (2013.01); *A41D 19/001* (2013.01); *A41D 19/0034* (2013.01); *A41D 19/0044* (2013.01); *A41D 19/0065* (2013.01); *A41D 19/0089* (2013.01); *A41D 19/0048* (2013.01); *A41D 19/01* (2013.01); *A41D 2400/10* (2013.01)

(58) Field of Classification Search
CPC ..... A41D 19/0006; A41D 19/001; A41D 19/0034; A41D 19/0041; A41D 19/0044; A41D 19/0055; A41D 19/0058; A41D 19/0065; A41D 19/0068; A41D 19/0082; A41D 19/0089; A41D 19/01; A41D 19/01529; A41D 19/0093; A41D 19/0037; A41D 13/081; A41D 19/0048; A41D 2400/10; A41B 11/02
USPC ..... 2/158, 162, 160, 164, 167, 168
See application file for complete search history.

(56) References Cited

U.S. PATENT DOCUMENTS

| | | | | |
|---|---|---|---|---|
| 1,597,042 | A * | 8/1926 | Beebe | A41D 19/015 2/162 |
| 2,036,413 | A | 4/1936 | Herbruck | |
| 2,083,684 | A | 6/1937 | Burke | |
| 2,187,430 | A | 1/1940 | Olmsted et al. | |
| 2,299,855 | A * | 10/1942 | Smith | H02G 1/02 2/162 |
| 2,446,921 | A | 4/1948 | Grant | |
| 3,009,164 | A * | 11/1961 | Frey | A41D 19/0055 2/170 |
| 3,173,150 | A * | 3/1965 | Mohler | A41D 19/0006 2/167 |
| 4,536,890 | A | 8/1985 | Barnett et al. | |
| 4,881,276 | A | 11/1989 | Swan | |
| 5,373,942 | A | 12/1994 | Weder | |
| 5,738,398 | A | 4/1998 | Miano | |

(Continued)

FOREIGN PATENT DOCUMENTS

GB 2 189 374 10/1987

*Primary Examiner* — Amy Vanatta
(74) *Attorney, Agent, or Firm* — Wendy W. Koba

(57) ABSTRACT

A hand cover including a glove or a mitten intended for use in cold weather conditions. An outer layer is made of silicone and has a thickness of 0.04 inches to 0.06 inches. A lining is made of polyester with a cotton fill and contacts the entire inside surface of the outer layer. The back and the front of the hand cover are spaced apart from each other which forms a hand access opening. A combination of a pair of hand covers and a strap bracelet which is held in loops on the hand covers.

11 Claims, 5 Drawing Sheets

(56) References Cited

U.S. PATENT DOCUMENTS 6,044,494 A * 4/2000 Kang ..... A41D 19/01547 2/161.1
6,775,849 B1 * 8/2004 Messman ..... A41B 11/002 2/239
7,234,170 B2 6/2007 Simic
7,347,019 B1 3/2008 Shaw
7,380,288 B1 * 6/2008 Duncan ..... A41D 19/01529 2/161.6
8,752,316 B1 6/2014 Dipaolo
2004/0172735 A1 * 9/2004 Garland ..... A41D 19/0034 2/160
2005/0108806 A1 5/2005 Llorente Lecue
2005/0278827 A1 * 12/2005 Price ..... A41D 19/01529 2/158
2006/0006573 A1 1/2006 McNamara
2006/0080757 A1 * 4/2006 Beyda ..... A41D 19/01529 2/164
2006/0195965 A1 * 9/2006 Knuth ..... A41D 19/0044 2/159
2007/0083980 A1 * 4/2007 Yang ..... A41D 19/0006 2/167
2008/0022436 A1 1/2008 Hull
2008/0092262 A1 * 4/2008 James Carr ..... A41D 19/0062 2/16
2009/0100562 A1 4/2009 Liang
2009/0106876 A1 4/2009 Yeung
2009/0139010 A1 * 6/2009 Bevier ..... A63B 71/148 2/161.8
2013/0056602 A1 3/2013 Zivku
2013/0180028 A1 * 7/2013 Kishihara ..... A41D 19/0065 2/168
2014/0000052 A1 1/2014 Filho et al.
2015/0143609 A1 * 5/2015 Francisco Costa ..... A41D 19/01547 2/167
2016/0029712 A1 * 2/2016 Hull ..... A41D 19/01529 2/16
2016/0120242 A1 * 5/2016 Thompson ..... A41D 19/001 2/161.6
2016/0286874 A1 * 10/2016 Kishihara ..... A41D 19/0006

* cited by examiner

COLD WEATHER GLOVES AND MITTENS

CROSS REFERENCE TO RELATED APPLICATIONS

This application claims benefit of U.S. Provisional Application No. 62/078,232, filed Nov. 11, 2014 (which is hereby incorporated by reference).

FIELD OF THE INVENTION

This invention relates to hand covers, namely gloves and mittens, and in particular to such hand covers for cold weather conditions including especially wet cold weather conditions such as snow.

BACKGROUND OF THE INVENTION

There are generally two types of gloves used by children and adults alike for cold weather, especially for snow conditions. The first type is a simple thin cotton glove. However, such cotton gloves get wet easily, especially in snow. A second type of glove or mitten for wet, cold weather conditions such as snow includes an outer water repellent material and a bulky lining which makes the whole glove or mitten bulky and thus less than completely comfortable and reduces the agility of the user's hands.

SUMMARY OF THE INVENTION

The present invention relates to a new and improved hand cover such as a glove or mitten which is relatively thin while providing dryness and warmth equal to or greater than that provided by the bulky cold weather gloves or mittens as known heretofore. Gloves or mittens of the present invention are formed of an outer layer and a lining.

The outer layer can be provided in different colors which will make it more attractive to users, especially children. In addition, the outer layer may be constructed with embossed nodules on the outer side thereof covering the user's palm to facilitate grabbing of objects including making snowballs and the like.

A main feature of a glove or mitten according to the present invention is that the outer layer is made of silicone. Silicone is a polymer that includes an inert synthetic compound made up of repeating units of silicone which is a functional group of two silicone atoms and one oxygen atom frequently combined with carbon and/or hydrogen. They are typically heat resistant and rubber-like and are used as sealants, adhesives, lubricants, medicines, cooking utensils and thermal and electric insulation.

The general literature describing silicones does not include use as a primary material in manufacturing cold weather gloves or mittens.

An important aspect of the present invention is that the silicone which forms the outer layer of the glove or mitten is of a thickness which would be water repellant to keep the user's hands dry and yet be thin enough to provide agility. Such thickness would also provide adequate warmth when combined with an inside lining of a suitable material. The thickness of the outer layer would also be selected so as to provide greater strength and resistance to tears or pulling apart and thus be durable without being bulky.

The lining which would provide a comfortable feel and warmth would preferably be formed of an inside layer of a polyester fabric plus cotton fill between the polyester fabric and the outer layer. The polyester fabric assists in making the glove or mitten waterproof, while the cotton fill provides comfort and warmth. The cotton fill is glued to the inside of the outer layer and sewn to the polyester fabric layer. The cotton fill would preferably have a bulk of an 80 grams per square meter (GSM).

Another feature of the present invention is that the silicone outer layer would terminate in the vicinity of the user's wrist so as to improve bendability of the wrist when performing activities in cold weather. At the wrist, the silicone outer layer is secured to a cuff which extends down below the hand. An advantage of the present invention is that silicone, unlike other conventional waterproof materials can be made in different colors which will make the gloves more vibrant and interesting to wearers of all ages, especially children.

Another feature of the present invention is that it is formed with side loops adapted to receive a strap bracelet . Strap bracelet s are well known novelty items comprising a length of stiff resilient material which naturally curls into a loop and is applied to the wrist as a bracelet by taking one end thereof and slapping it against the wearer's wrist such that it initially straightens out and then curls around the user's wrist.

The present invention combines the gloves or mittens of the present invention with a strap bracelet by providing loops on one side adapted to receive the strap bracelet in its natural curled up condition.

Thus, it is an object of the present invention to provide a new and improved glove or mitten for wet, cold weather conditions.

It is another object of the present invention to provide a glove or mitten for cold weather conditions which optimizes or maximizes strength and warmth while having a reduced overall thickness.

It is another object of the present invention to provide a glove or mitten for cold weather conditions with an outer layer made of silicone and a lining.

It is another object of the present invention to provide a glove or mitten for cold weather conditions made of a material which can be formed in many different colors.

It is another object of the present invention to provide a glove or mitten in combination with and adapted to hold a strap bracelet.

These and other objects of the present invention will be apparent from the detailed description to follow, together with the accompanying drawings.

BRIEF DESCRIPTION OF THE DRAWINGS

There follows a detailed description of the present invention, to be read together with the accompanying drawings, in which.

DETAILED DESCRIPTION OF THE PREFERRED EMBODIMENTS

Figure 1:
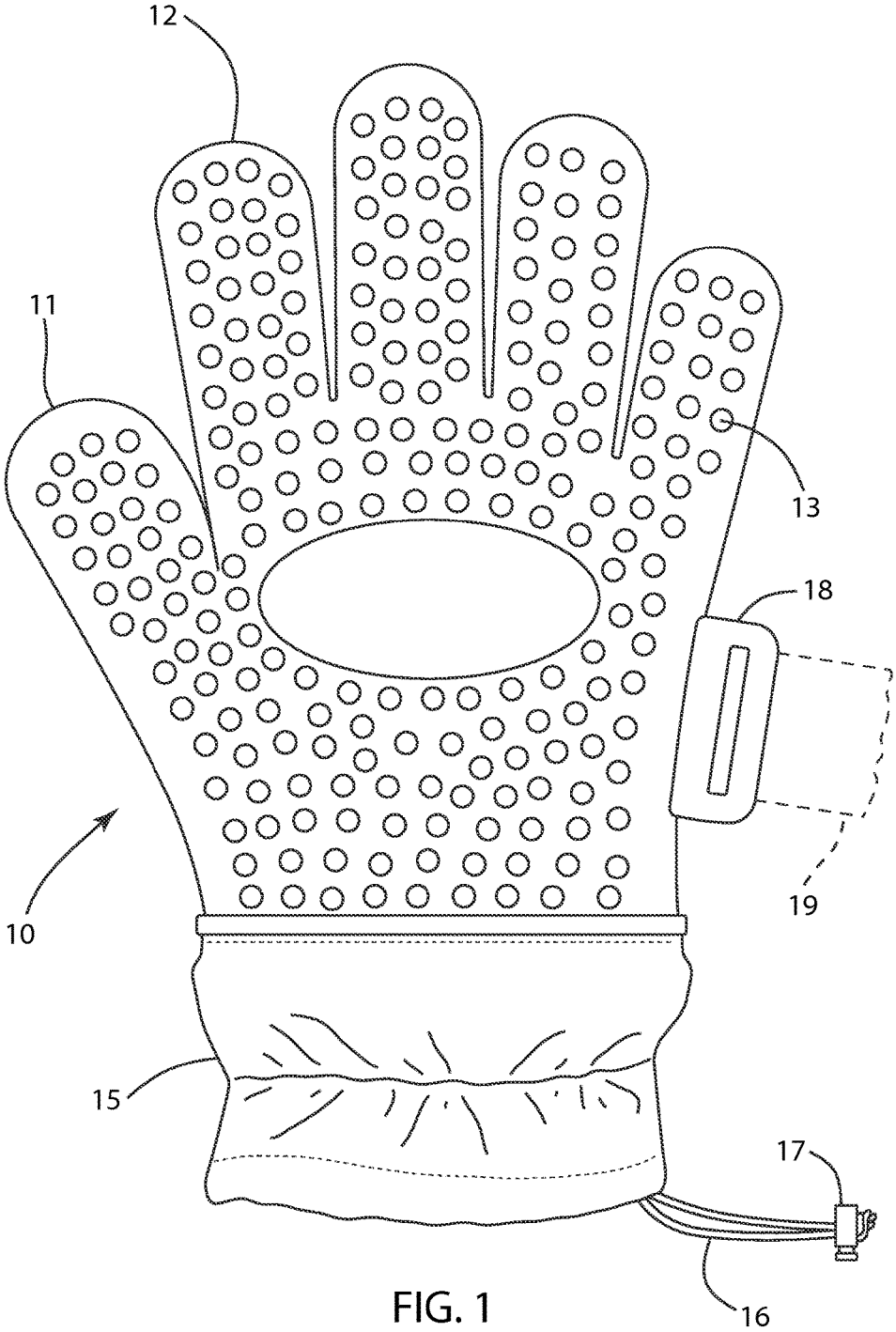
FIG. 1 is a front view of a glove including the features of the present invention.

Referring to the figures, like elements represent like numerals throughout the several views.

FIGS. 1-9 show a hand cover 10 made in accordance with the present invention. The embodiment of FIGS. 1-9 shows a glove having a thumb portion 11 and four finger portions 12. An outer layer made of silicone extends from the thumb and fingers down to an opening 20 at the wearer's wrist (see FIG. 2). Attached to and extending downwardly from the outer layer is a cuff 15 to cover the wearer's wrist. A sliding cord lock 17 can then tighten the cuff on the user's wrist.

Figure 2:
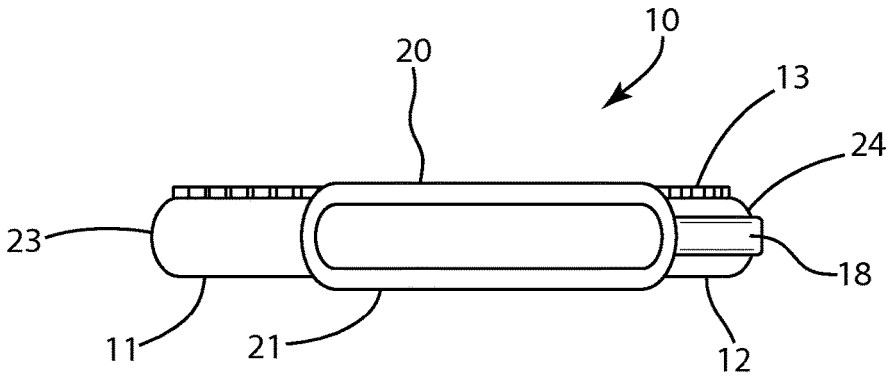
FIG. 2 is an end elevational view of just the outer layer.
Figure 3:
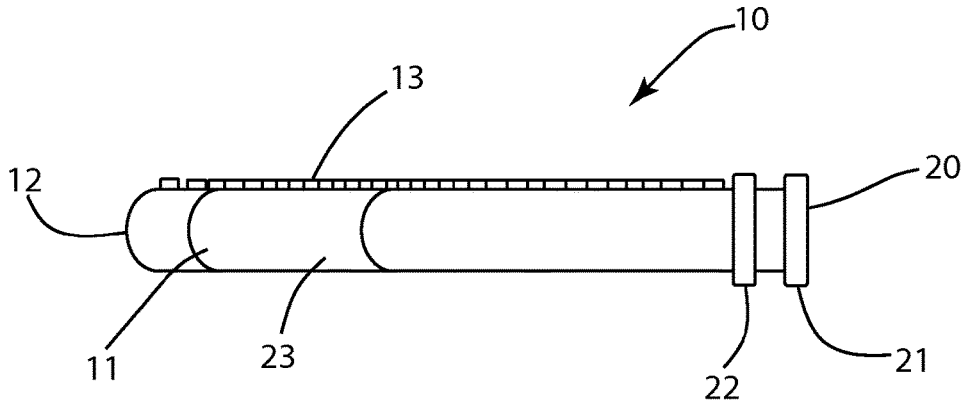
FIG. 3 is a side elevational view of just the outer layer.

Referring to FIGS. 2 and 3, the silicone material is stiff enough that the sides of the glove and all around its periphery, including a first side 23 and a second side 24, separate the front of the glove from the back of the glove so as to allow room for a user's hand to fit comfortably therein, and also to form in its natural state an opening 20 at the wrist end of the glove. As shown in FIG. 3, the wrist end includes an outer ridge 21 and an inner ridge 22 encircling the silicone outer layer at the opening 20 and inwardly from the opening 20, respectively.

Figure 4:
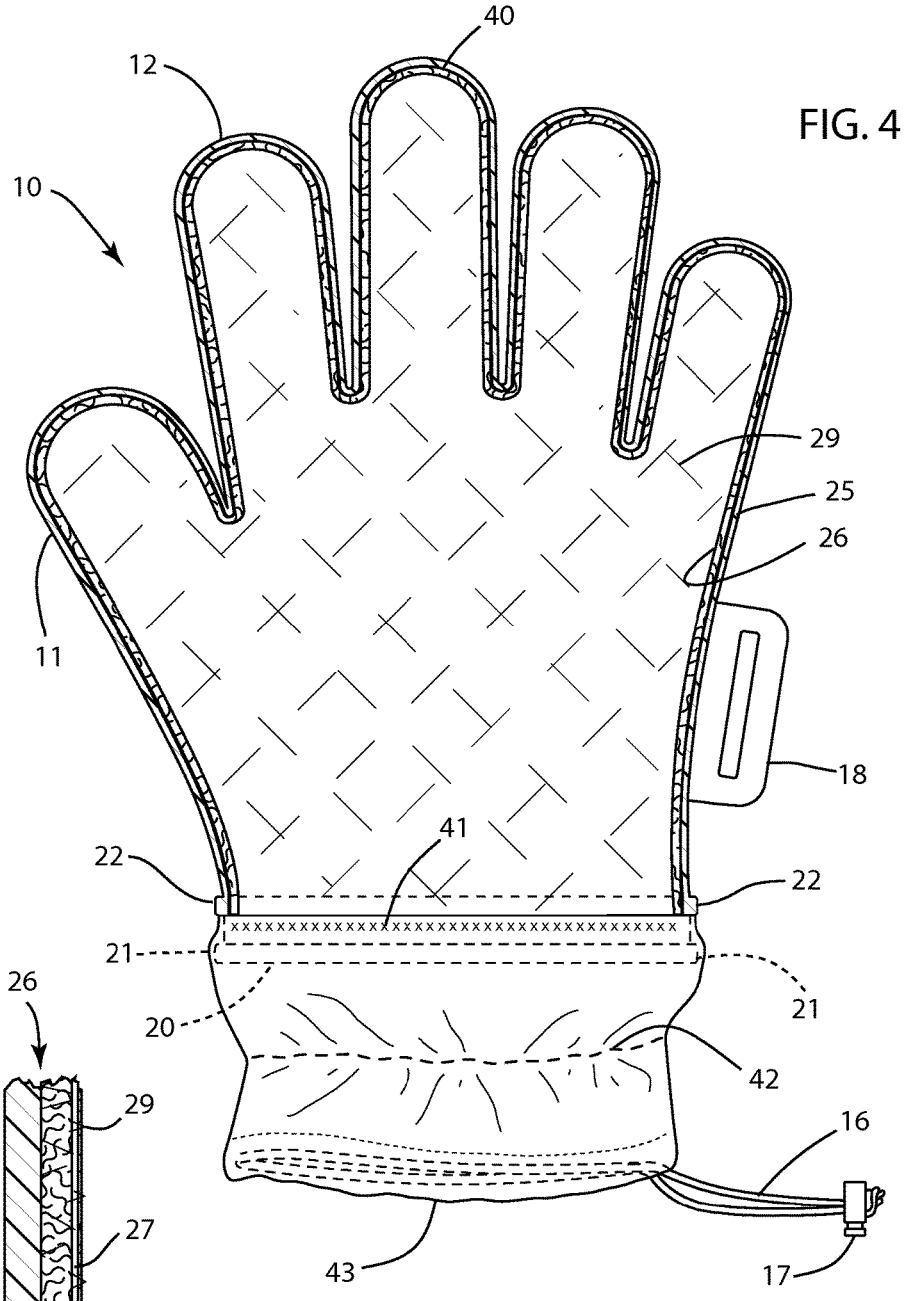
FIG. 4 is a partial cross-sectional view through FIG. 1, taken in a plane parallel to the plane of the figure and in the mid-plane of the glove so as to show the inside of the back of the glove, plus an elevational view of the cuff.

Referring to FIG. 4, the cuff 15 is made of a suitable strong fabric material which is attached around the silicone outer layer just below the ridge 22, as shown at 41. The cuff is held outwardly by encircling the outer ridge 21. An elastic band 42 may be added to draw in the cuff 42. The open end of the cuff encloses a cord 16 which has thereon a slideable cord lock 17.

Embossed nodules 13 on the outside of the front of the glove are provided to enhance grabbing of articles, snow or the like.

The outer layer is made of silicone, also referred to as silicone rubber. Silicone has many advantages. It is a versatile, inert, very flexible, has superior resistance to water and makes an excellent insulator. By its nature, silicone can be provided in many different colors which makes it attractive and fun for users of all ages, especially children. Also, silicone is tougher than cotton. It is durable and will not tear or fray, and it is very easy to clean.

Figure 6:
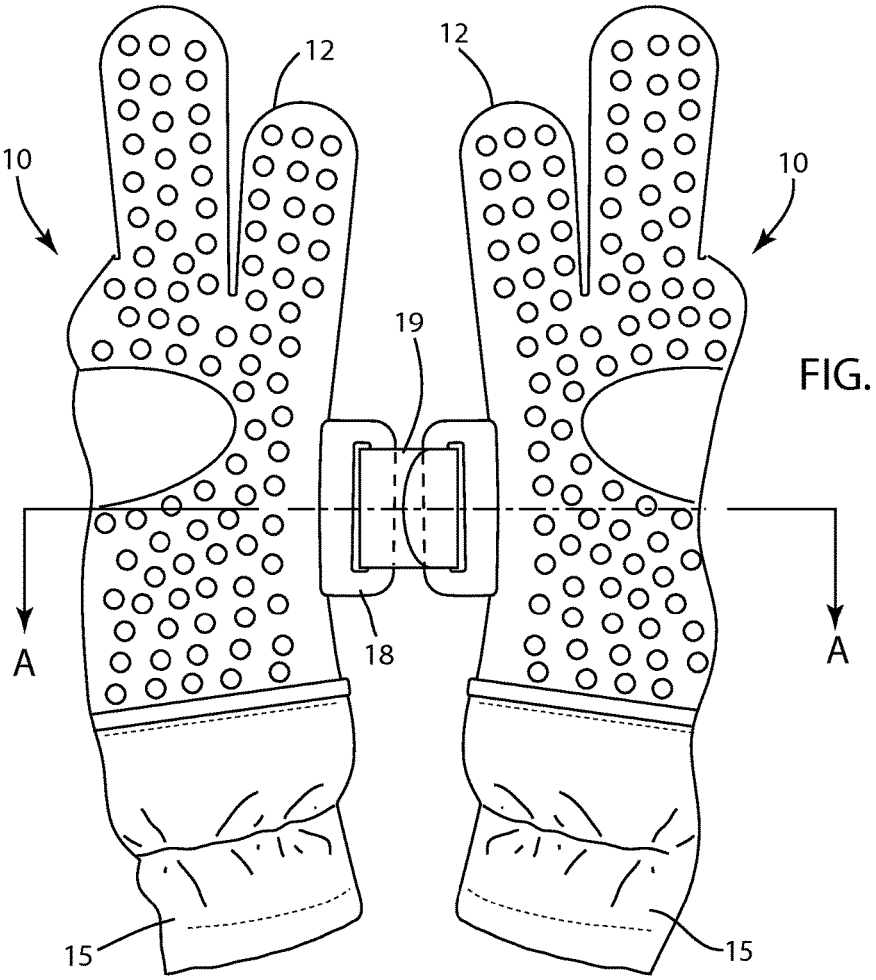
FIG. 6 is a partial view showing the front of two gloves of the pair.

Also shown in FIGS. 1, 4 and 6 is a loop 18 for receiving a strap bracelet as shown at 19.

FIG. 4 shows the inside of the back of the glove. The silicone outer layer is designated 25 and the lining made of polyester fabric with a cotton fill is shown at 26.

Figure 5:
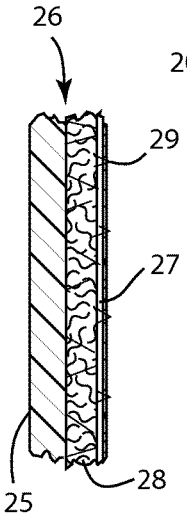
FIG. 5 is a greatly enlarged cross-sectional view of a portion of the outer layer and lining.

Referring to FIGS. 4 and 5, the lining 26 comprises an inside layer of a polyester fabric 27 with loose cotton fill 28 placed between the polyester fabric layer 27 and the silicone outer layer 25. The cotton is connected to the polyester fabric layer 27 by suitable stitching as shown at 29 in FIGS. 4 and 5. Also, the lining is adhered to the inside of the outer layer by adhesively connecting the cotton fill to the inside of the silicone outer layer at suitable points, for example, at the tips of the thumb and fingers as shown at 40. The cotton fill preferably has a density of 80 grams GSM.

It has been found that the optimal thickness of the outer layer is between 0.05 inches and 0.08 inches, preferably 0.0625 inches. This thickness has sufficient strength to hold up well to tears and pulling, while also avoiding bulkiness, being durable and providing dryness. Also a silicone outer layer makes it possible to utilize a thinner lining because of the superior insulation qualities of silicone. The nodules 13 preferably have a height which is the same as the thickness of the outer layer. As noted above, the silicone outer layer has a stiffness which permits the sides of the glove to space the front and back of the outer layer from each other as shown in FIGS. 2 and 3, and in particular, to provide the opening 20 as shown in FIG. 2. Such spacing makes it easy for the user to insert his or her hands into the glove while being sufficiently thin (together with the flexibility of the silicone material), to allow the glove to have agility. The preferred thickness of the glove from the outside of the back to the outside of the front, excluding the nodules, would be approximately 0.68 inches.

Figure 7:
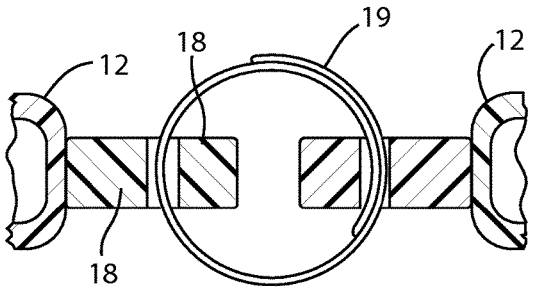
FIG. 7 is a cross sectional view along line A-A of FIG. 6.
Figure 9:
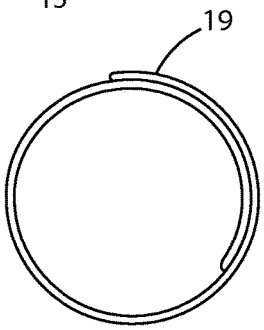
FIG. 9 shows a strap bracelet in its natural curled condition.
Figure 8:
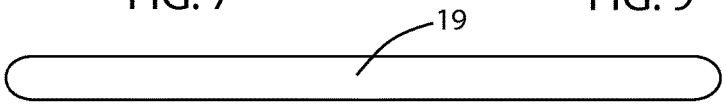
FIG. 8 shows a strap bracelet in its straight condition.

FIG. 6 shows partially a pair of gloves with adjacent loops 18 of the pair of gloves joined by a strap bracelet 19. FIG. 7 is a plan view of the loops 18 and strap bracelet 19. FIG. 8 shows the strap bracelet 19 in a straight condition, and FIG. 9 shows the strap bracelet 19 in its natural curled condition.

Figure 10:
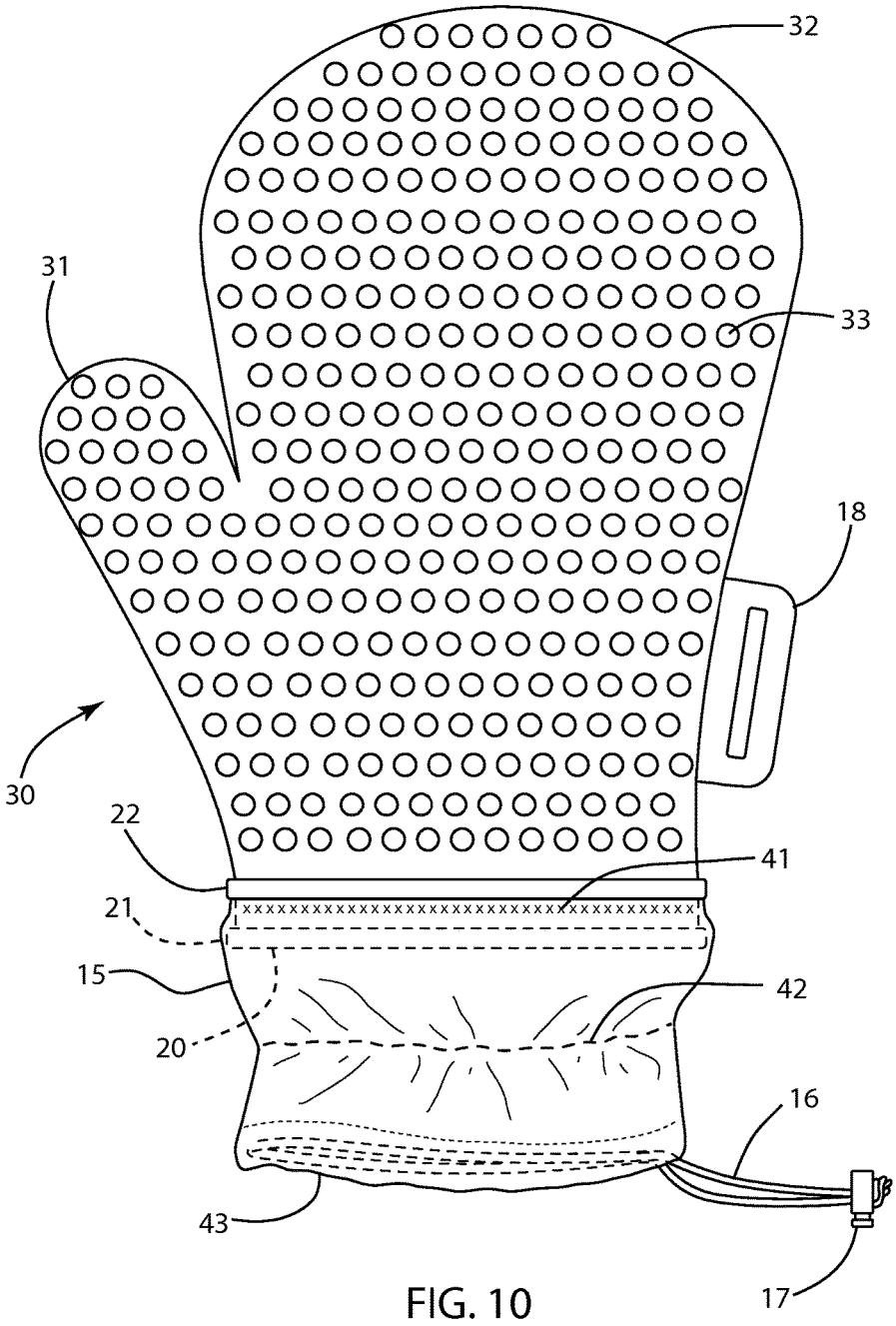
FIG. 10 shows another embodiment of the present invention as applied to a mitten.

FIG. 10 shows another embodiment of the present invention in the form of a mitten 30 having a thumb portion and a total finger covering portion 32 with embossed nodules 33. In all respects, other than the fact that FIG. 10 shows a mitten instead of a glove, the embodiment of FIG. 10 is identical to the embodiment of FIGS. 1 through 9.

These and other details and advantages of the present invention will be apparent to those of ordinary skill in the art, without departing from the spirit and scope of the invention.

The invention claimed is:

1. A hand cover comprising:

an outer thin layer made of silicone having a thickness in the range of 0.05 to 0.08 inches, which has a hand access opening at a wrist area thereof, a back, a front and sides surrounding the hand cover except at the hand access opening, the sides being of a stiffness which separates the front and back from each other, a first ridge encircling an outer surface of the outer thin layer adjacent the hand access opening and a second ridge encircling the outer surface of the outer thin layer adjacent to the first ridge, a lining shaped to contact an inner surface of the silicone outer layer, and a cuff connected to the outer surface of the outer thin layer between the first and second ridges, which cuff extends therefrom to cover the wrist of a user.

2. A hand cover according to claim 1, wherein the hand cover is a glove.

3. A hand cover according to claim 1, wherein the hand cover is a mitten.

4. A hand cover according to claim 1, wherein the lining comprises a polyester fabric and cotton fill between the polyester fabric and the outer thin layer.

5. A hand cover according to claim 4, wherein the cotton fill has a density of 80 GSM.

6. A hand cover according to claim 1, wherein the material of the outer thin layer has a thickness of 0.0625 inches.

7. A hand cover according to claim 6, wherein the front of the hand cover has nodules rising above the surface thereof to a height approximately equal to the thickness of the outer thin layer.

8. A hand cover according to claim 1, including a loop at the side of the outer thin layer.

9. A hand cover according to claim 1, wherein the separation between the front and the back is such that the total thickness of the hand cover is approximately 0.68 inches.

10. A hand cover comprising an outer thin layer made of silicone, the thickness of the silicone layer being 0.05-0.08 inches, and having a hand access opening, a lining shaped to contact an inner surface of the silicone outer thin layer, the lining comprising a polyester fabric and a cotton fill between the outer thin layer and the polyester fabric, the cotton fill being connected to both of the polyester fabric and an inside surface of the outer thin layer, and a cuff connected to an outer surface of the outer thin layer adjacent the hand access opening and extending therefrom covering a wrist of the user, and including a first ridge encircling the outer surface of the outer layer adjacent the hand access opening and a second ridge encircling the outer surface of the outer thin layer adjacent to the first ridge, and the cuff being connected to the outer surface of the outer thin layer between the first ridge and the second ridge.

11. A hand cover according to claim 10, the hand cover having a back, a front and sides, and the sides spacing the front from the back such that the overall thickness of the hand cover is approximately 0.68 inches.

* * * * *